United States Patent [19]

Wilsdon et al.

[11] 4,117,440

[45] Sep. 26, 1978

[54] FUSE MOUNT FOR SWITCHING APPARATUS

[75] Inventors: Thomas A. Wilsdon, Alden; William P. Heim, Cheektowaga; Glenn A. Barlis, Fairport, all of N.Y.

[73] Assignee: Westinghouse Electric Corp., Pittsburgh, Pa.

[21] Appl. No.: 760,488

[22] Filed: Jan. 19, 1977

[51] Int. Cl.[2] ..... H01H 85/50; H01H 85/60

[52] U.S. Cl. ..... 337/213; 337/193

[58] Field of Search ..... 337/213, 214, 215, 168, 337/169, 170, 171, 172, 173, 174, 175, 180, 193, 7; 339/262 F

[56] References Cited

U.S. PATENT DOCUMENTS 3,264,431 8/1966 Hodgson ..... 337/7

*Primary Examiner*—Harold Broome

*Attorney, Agent, or Firm*—L. P. Johns

[57] ABSTRACT

A circuit interrupter characterized by a stationary contact, a movable, elongated, tubular fuse in which one end of the fuse is swingably mounted about the other end in a predetermined path to open and close a circuit through the contact, and the other end of the fuse being pivotably seated between supporting conductors which are peripherally spaced around the fuse and one of which conductors is a leaf spring biased against said other end of the fuse.

7 Claims, 9 Drawing Figures

FIG. I
PRIOR ART

FUSE MOUNT FOR SWITCHING APPARATUS

BACKGROUND OF THE INVENTION

1. Field of the Invention

This invention relates to switching apparatus, and, more particularly, it pertains to a fuse mounting therein.

2. Description of the Prior Art

Fuse holders for use in switching apparatus have heretofore been of two general types, that is, the "clip type" and "clamp type". The clip type holder comprises a generally U-shaped resilient clip for receiving a fuse terminal. However, it has been found impractical to provide a high contact pressure with the clip fuse holder because of a difficulty of inserting the fuse in the holder. The clamp type holder used heretofore have been designed to reduce the difficulty of fuse insertion but the special conditions to which fuse holders are subjected have been unsuccessful in service.

Associated with the foregoing has been a problem of economics. A fuse holder such as the type disclosed in U.S. Pat. No. 3,264,432 for rockably supporting the lower ferrule or contact end of a power fuse comprises heavy copper castings or punchings which require thick sections of copper that performed satisfactorily but were bulky and expensive.

SUMMARY OF THE INVENTION

In accordance with this invention, it has been found that the foregoing problems may be overcome by providing a fuse holder or fuse mount for switching apparatus which comprises cooperable switch members including a stationary contact and a movable elongated tubular fuse, wherein one end of the fuse is swingable about the other end of the fuse in a predetermined path rearward and forward, respectively, to and from the stationary contact to close and open a circuit between the stationary contact and one end of the fuse, the fuse having a peripheral surface extending longitudinally of the fuse, support means for pivotally supporting the other end of the fuse comprising means for clamping the peripheral surface and including peripherally spaced members, one of the members being a sheet-like leaf spring having one end yieldingly urging the fuse against the other of the members, the support means also comprising a channel-shaped base including spaced flanges and an intermediate portion, the leaf spring being secured on the spaced flanges, and the other members being peripherally spaced stub-like conductors which are electrically connected to the base.

The advantage of the fuse holder of this invention is that it is comprised of metal stampings which are not only cheaper than metal castings, but also conserve raw materials such as copper and silver.

BRIEF DESCRIPTION OF THE DRAWINGS

FIG. 1A is an isometric view of the base portion of the fuse holder shown in FIG. 1;

FIG. 1B is an isometric view of the clamp shown in FIG. 1;

DESCRIPTION OF THE PREFERRED EMBODIMENT

Figure 1:
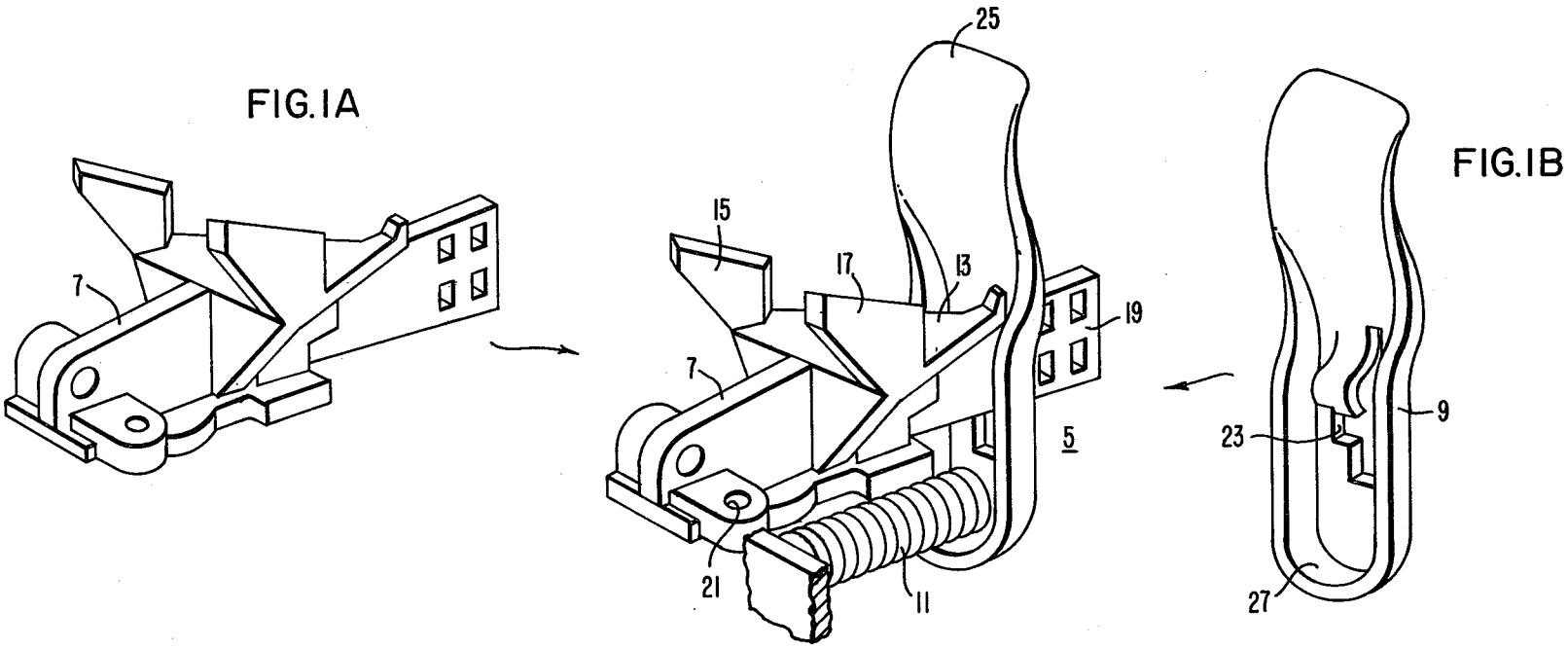
FIG. 1 is an isometric view of a prior art type of fuse holder, showing the separate parts in broken line positions.

Briefly, a fuse holder of prior art construction is generally indicated at 5 in FIG. 1 and is comprised of three parts, including a base 7, a clamp 9, and a coil spring 11. The base 7 is an integral member comprising a support surface 13, spaced stubs 15, 17, and a flange 19. In addition, the base includes spaced apertures 21 (one of which is shown) for securing the fuse holder 5 on a suitable frame. The clamp 9 comprises an opening 23 through which the flange 19 extends for pivotal mounting of the clamp. An upper end portion is curved at 25 to facilitate insertion of a fuse between the clamp and the stubs 15, 17. The lower end of the clamp is cup-shaped at 27 for retaining one end of the spring 11, which in turn biases the upper end 25 of the clamp against a fuse.

The base 7 is a metal casting of relatively heavy thickness and the clamp 9 is a punching or stamping of relatively thick metal. Both the base 7 and the clamp 9 are preferably composed of a metal having a high coefficient of electrical conductivity, such as copper. As was set forth above, the disadvantage of the fuse holder 5 is that it is comprised of relatively heavy members of a costly material, namely, copper.

Figures 2, 2A, 2B, 2C, 2D:
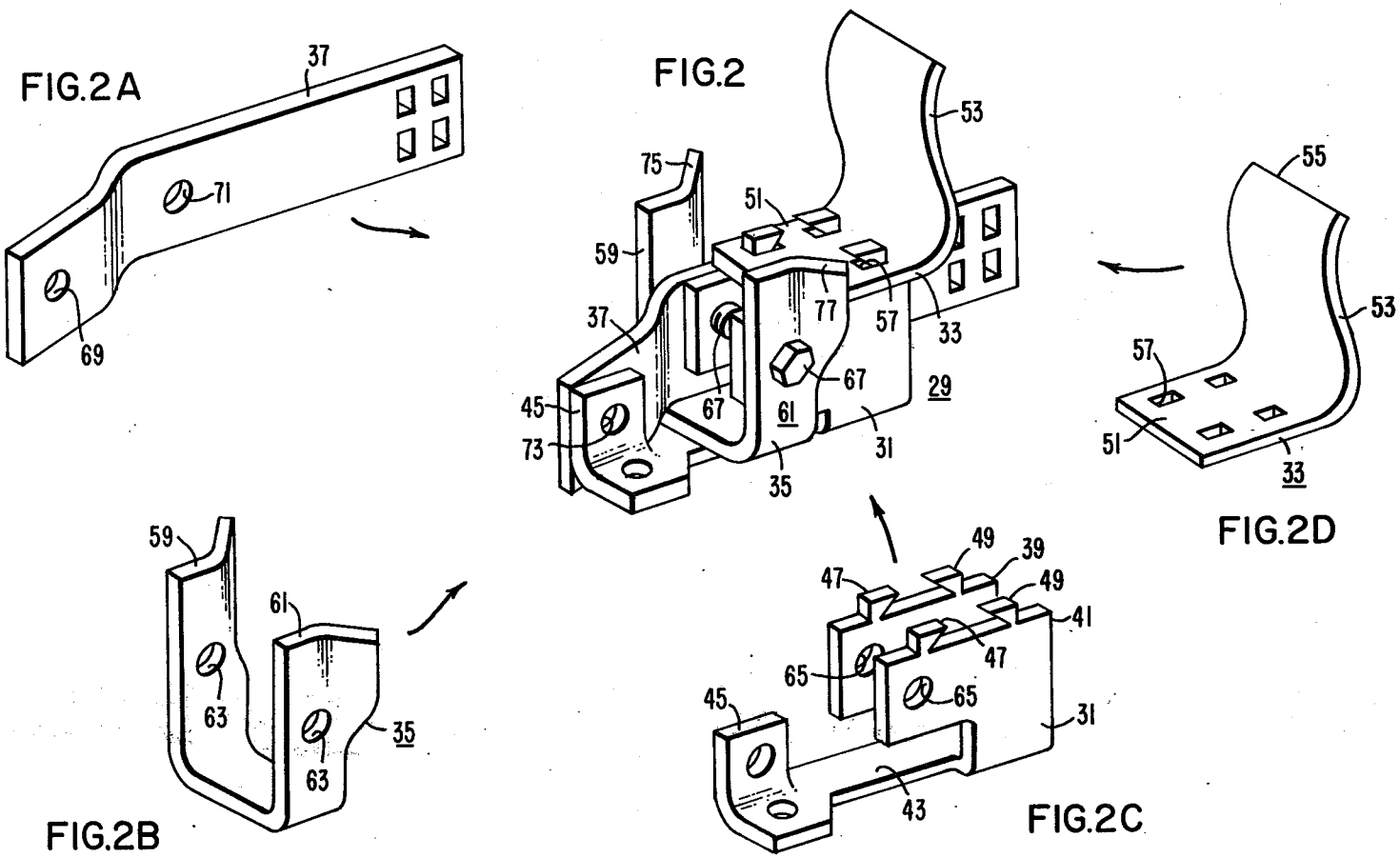
FIG. 2 is an isometric view of the type of fuse holder of this invention, showing the separate parts in broken line positions.
FIG. 2A is an isometric view of the conductor of FIG. 2.
FIG. 2B is an isometric view of the jaw of the fuse holder of FIG. 2.
FIG. 2C is an isometric view of the base of the fuse holder of FIG. 2.
FIG. 2D is an isometric view of the spring of the fuse holder of FIG. 2.

In FIG. 2 a fuse holder of this invention generally indicated at 29 is composed of four separate parts comprising a base 31, a leaf spring 33, a jaw member 35, and a conductor 37. The base 31 is a generally U-shaped member having a pair of spaced flanges 39, 41 and an intermediate portion 43, the extremity of which comprises an upturned flange 45. The base 31 is preferably comprised of a steel punching or stamping with the upper ends of each flange 39, 41 including similar keystone tabs 47, 49.

The leaf spring 33 is a generally L-shaped member comprising a base portion 51 and an upright portion 53, the upper end 55 of which is curved outwardly. The base portion 51 includes four holes 57 through which the keystone tabs 47, 49 extend and are twisted to lock the leaf spring 33 in place.

The jaw member 35, being formed from copper bar, comprises upturned stub-like conductors 59, 61. The conductors 59, 61 include similar apertures 63 which align with corresponding apertures 65 in the flanges 39, 41 of the base 31, so that the base and jaw members are retained together by similar bolts 67.

The conductor 37, being a punching or stamping of copper, extends between one of the flanges 39 and the flange 45. The conductor 37 having spaced holes 69, 71 is connected by a bolt 73 to the flange 45 and to the flange 39 by the bolt 67. Thus, the conductor 37 provides additional conductor means for carrying current from the jaw member 35 and the end portion of the portion 43 having the flange 45 where electric current is conducted to adjacent parts of the switching apparatus.

Moreover, the stub-like conductors 59, 61 comprise outturned flanges 75, 77, respectively, for providing surface-to-surface contact with the lower end of a fuse when the latter is disposed between the conductors and the leaf spring portion 53.

Figure 3:
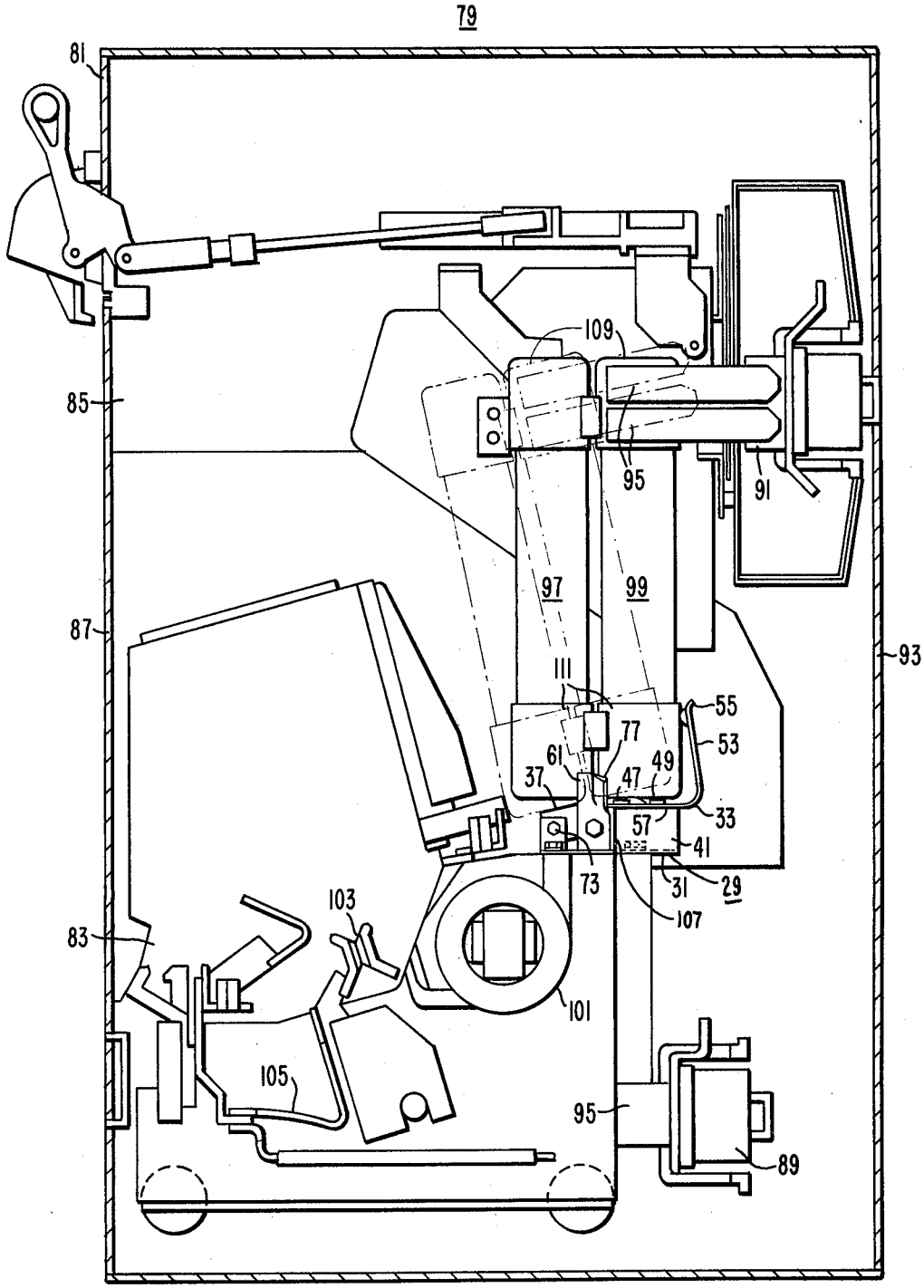
FIG. 3 is a vertical sectional view of switching apparatus employing the fuse holder of this invention.

The fuse holder 29 (FIG. 2) is adapted for use in a type of switching apparatus shown in FIG. 3 and as generally disclosed in U.S. Pat. No. 3,264,431, to which reference is made. In that patent, a complete description of the construction and operation of the switching apparatus employing a fuse as a movable contact is provided, for which reason the description is limited herein to only the essential parts.

In FIG. 3 a high voltage motor starter or circuit interrupter for starting and controlling AC motors is generally indicated at 79 and it comprises a cabinet 81 in which high voltage modular plug-in assemblies are disposed. The plug-in assemblies comprise a contactor unit 83 and an isolating switch unit 85, each being slidably removable from the cabinet housing to which access is provided by a hinged access door 87. Electrical terminal assemblies 89, 91 are mounted on the interior surface of a rear panel 93, which electrically engage the units 83, 85, respectively. Three-phase output power flows through the motor starter 79 from the line terminal assembly 91 through stab contacts 95, power fuses 97 and 99, fuse holder 29, electromagnetic blowout coil 101, contacts 103, shunt 105, and load terminal assemblies 89.

The isolating switch unit 83 comprises, among other things, a frame 107 on which the fuse holder 29 is mounted to hold the fuses 97, 99 in place, whether the fuses are in the retracted (broken line) position or the advanced (solid line) or closed circuit position. The fuses 97, 99 comprise similar upper and lower metal ferrules 109, 111 for conducting current into and from the fuse body. The lower ferrule 111 is in surface contact with the upright portion 53 of the leaf spring 33 as well as the stub-like conductors 59, 61 and, more particularly, the outturned flanges 75, 77 thereof. The conductors 59, 61 are peripherally spaced from the upright portion 53 and cooperate to electrically engage the fuse ferrule 111, particularly when the fuse is in the upright or closed circuit position when the leaf spring portion 53 is deflected or bent to the right, as viewed in FIG. 3.

Accordingly, the fuse holder construction disclosed herein provides for the conservation of copper by limiting its use to locations where it is of primary service.

What is claimed is:

1. In a circuit interrupter having cooperable switch members including a stationary contact and a movable elongated tubular fuse, and wherein one end of the fuse is swingable about the other end of the fuse in a predetermined path rearward and forward respectively toward and from the stationary contact to respectively close and open a circuit between the stationary contact and the one end of the fuse, the fuse having a peripheral surface extending longitudinally of the fuse, support means for pivotably supporting the other end of the fuse comprising clamping means for clamping the peripheral surface and including peripherally spaced members, one of which members is a flexible member having one end yieldingly urging the fuse against the other of the members and having another end fixedly secured in place, and said one end extending at a substantially right angle to the other end.

2. The circuit interrupter of claim 1 in which the flexible member is a sheet-like member and is bendable away from the other of said members upon placement of the fuse on the support means.

3. The circuit interrupter of claim 1 in which the flexible member is a leaf spring.

4. The circuit interrupter of claim 3 in which the support means comprises a base on which the other end portion of the leaf spring is fixedly secured.

5. The circuit interrupter of claim 4 in which the other of said members comprise peripherally spaced stub-like conductors.

6. The circuit interrupter of claim 5 in which the base is a channel including spaced flanges, and the leaf spring being secured to the spaced flanges.

7. The circuit interrupter of claim 6 in which the stub-like conductors are electrically connected to the base.

* * * * *